US010730661B2

(12) United States Patent
Westendorf et al.

(10) Patent No.: US 10,730,661 B2
(45) Date of Patent: Aug. 4, 2020

(54) CARGO PALLET WITH EXTRUDED SLOT

(71) Applicant: HFW Solutions, Inc., Rapid City, SD (US)

(72) Inventors: Chad Westendorf, Rapid City, SD (US); Casey Allen, Rapid City, SD (US); Michael Skinner, Rapid City, SD (US)

(73) Assignee: HFW SOLUTIONS, INC., Rapid City, SD (US)

( * ) Notice: Subject to any disclaimer, the term of this patent is extended or adjusted under 35 U.S.C. 154(b) by 0 days.

(21) Appl. No.: 16/352,622

(22) Filed: Mar. 13, 2019

(65) Prior Publication Data

US 2019/0283931 A1 Sep. 19, 2019

Related U.S. Application Data

(60) Provisional application No. 62/642,346, filed on Mar. 13, 2018.

(51) Int. Cl.
*B65D 19/00* (2006.01)

(52) U.S. Cl.
CPC ..... *B65D 19/0012* (2013.01); *B65D 19/0002* (2013.01); *B65D 2519/00024* (2013.01); *B65D 2519/00059* (2013.01); *B65D 2519/00273* (2013.01); *B65D 2519/00278* (2013.01); *B65D 2519/00293* (2013.01); *B65D 2519/00323* (2013.01); *B65D 2519/00343* (2013.01); *B65D 2519/00562* (2013.01); *B65D 2519/00815* (2013.01)

(58) Field of Classification Search
CPC ..... B65D 2519/00815; B65D 2519/00059; B65D 2519/00273; B65D 2519/00293; B65D 2519/00562; B65D 19/00; B65D 19/0002
USPC ..... 108/55.1, 55.3, 55.5, 54.1, 56.1, 57.32
See application file for complete search history.

(56) References Cited

U.S. PATENT DOCUMENTS 2,052,914 A * 9/1936 Williams ..... B60P 3/075 410/9
2,735,377 A * 2/1956 Elsner ..... B63B 25/28 410/105
2,828,931 A * 4/1958 Harvey ..... B65D 19/0095 410/46
3,396,678 A * 8/1968 Jensen ..... B64D 11/0696 248/346.02
3,478,995 A * 11/1969 Lautzenhiser ..... B61D 45/002 410/104
3,509,832 A * 5/1970 Daisley, Jr. ..... B65D 19/0002 108/57.25
3,563,181 A * 2/1971 Mietla ..... B60P 3/073 410/11

(Continued)

*Primary Examiner* — Jose V Chen
(74) *Attorney, Agent, or Firm* — Gordon Rees Scully Mansukhani, LLP

(57) ABSTRACT

A panel structure comprised of a plurality of extruded aluminum panel members. The aluminum panel members are joined together into a single structure by a friction stir welding process and at least one of the extruded aluminum panel members includes an extruded slot running along an entire length of the at least one of the extruded aluminum panel members. The extruded slots are used to attach hooks or other suitable retaining devices for securing objects to the panel structure or to directly attach structural elements or modules to the panel structure.

16 Claims, 5 Drawing Sheets

(56) References Cited

U.S. PATENT DOCUMENTS

| | | | | | |
|---|---|---|---|---|---|
| 3,592,145 | A * | 7/1971 | Petry | B64D 9/00 | 108/57.21 |
| 3,622,114 | A * | 11/1971 | McIntire, Jr. | B65D 19/0002 | 248/346.02 |
| 3,877,671 | A * | 4/1975 | Underwood | B61D 45/002 | 248/346.03 |
| 3,972,500 | A * | 8/1976 | Johnson | B60P 7/10 | 410/85 |
| 4,700,923 | A * | 10/1987 | Lewis, Jr. | F16M 3/00 | 248/500 |
| 4,796,539 | A * | 1/1989 | Berrett | B64D 9/00 | 108/54.1 |
| 5,137,405 | A * | 8/1992 | Klein | B60P 7/08 | 410/104 |
| 5,674,033 | A * | 10/1997 | Ruegg | B60P 3/079 | 410/101 |
| 6,308,642 | B1 * | 10/2001 | Branam | B65D 19/0002 | 108/55.1 |
| 6,514,021 | B2 * | 2/2003 | Delay | B60P 7/0815 | 410/104 |
| 6,981,685 | B1 * | 1/2006 | McHugh | F16M 5/00 | 248/188.1 |
| 8,776,698 | B2 * | 7/2014 | Pherson | B65D 19/0002 | 108/51.3 |
| 2005/0132937 | A1 * | 6/2005 | Branam | B65D 19/0002 | 108/55.5 |
| 2008/0237305 | A1 * | 10/2008 | Rennick | B23K 20/1225 | 228/112.1 |
| 2019/0322414 | A1 * | 10/2019 | Chan | B60P 7/0876 | |

* cited by examiner

CARGO PALLET WITH EXTRUDED SLOT

CROSS REFERENCE TO RELATED APPLICATION

The present application claims priority and the benefit of U.S. Provisional Patent Application No. 62/642,346 filed Mar. 13, 2018. The foregoing provisional application is incorporated by reference herein in its entirety.

BACKGROUND

The present application relates to military and commercial cargo transport structures, such as cargo pallets and intermodal shipping containers. The disclosed structure is especially suited to a cargo pallet, particularly a cargo pallet that is used to restrain cargo on transport structures.

A cargo pallet is a flat transport structure that supports goods in a stable fashion while being lifted by a forklift, pallet jack, front loader, work saver, crane, or other jacking device. Goods or shipping containers are often placed on a pallet secured with strapping, stretch wrap or shrink wrap and shipped. Cargo pallets can be made of wood, plastic, metal, or other materials. Cargo pallets made from aluminum have an advantage in that the metal panels used to assemble the cargo pallet are lightweight and malleable. Decreasing the weight of the panel in a structure may allow for increased loading on the panel and assembled structure. Aluminum panels can be prefabricated in modular units and joined together on site when placed in service. Aluminum panels are also more easily transported than heavier metals or preformed concrete. Furthermore, aluminum panels may be employed in new structures, or the panels may be used to refurbish an aging structure.

Cargo pallets typically consist of several panel members that have been joined together at their vertical seam abutments by various welding, filling, or fastening methods. Welding the panel faying surfaces (abutments) typically provides for more rigidity and increased load distribution, whereas non-welded fasteners allow enhanced and semi or fully-independent movement as between modular panels under changing load conditions. For structures where welded joints are desired, the use of friction stir welding ("FSW") techniques has developed as one possible method for joining the members.

Friction stir welding generally includes the application of a pin or probe to the surface of a joint or seam. The pin applies pressure and friction (typically by spinning) on the seam sufficient to cause the metal of the faying surface to plasticize. The pin may be separately heated, but typically is designed to cause the metal to plasticize purely as a result of pressure without the need for additional heat or electricity. The pin moves along the length of the faying surface, and the plasticized metals from adjoining members are effectively "stirred" and intermix in the void created by the pin movement, thereby creating a weld seam. Additional filler material is typically unneeded. Because the yield strength threshold for various metals are usually well known, the FSW tool and pin can be precisely calibrated to apply no more than the exact pressure needed to cause the metal to plasticize and weld. This precise calibration also means that the weld joint cools and hardens almost immediately after the pin has passed a point in the faying surface. This results in a relatively instant weld without the application of broader heat, which can cause unwanted deformations.

Military cargo pallets, such as the standardized U.S. military 463L Master Pallet, are usually constructed with a smooth aluminum alloy exterior and a balsa wood core. Attachment of cargo to such a conventional pallet is accomplished by attaching chains or nets to tie-down rings located on the perimeter of the pallet. For example, the 463L Master Pallet has 22 tie-down rings that run along its edge. In FIG. 1, a conventional cargo pallet 10 is shown. Similarly, to the 463L Master Pallet described above, the cargo pallet 10 includes tie-down rings 12 that extend along the perimeter of the pallet 10. The cargo pallet 10 contains an exterior of aluminum, with a balsa wood core. As FIG. 1 shows, attachment of cargo to this type of conventional pallet is limited to the perimeter of the pallet 10.

Another type of cargo pallet exists that is composed solely of aluminum, and eliminates the balsa wood core that is traditionally used in the 463L Master Pallet. Unlike cargo pallets that contain a wood core, these all-aluminum pallets may include external and separate anchoring mechanisms (e.g., anchoring rails that may include slots) that are bolted on the aluminum structural members, and therefore can provide more attachment options than the 463L Master Pallet. FIG. 2 illustrates one such cargo pallet. The cargo pallet 20, shown in FIG. 2, is composed solely of aluminum, and thus eliminates the balsa wood core. Although these all-aluminum pallets provide more attachment options for anchoring cargo or other structures positioned on the pallet, the attachment options require external devices that are typically connected to the pallet using rivets and bolts. For example, the D-ring anchors positioned on the edge of the pallet are connected to the pallet using a process that may include machining and drilling the pallet before fastening the anchor rings using bolts. The requirement to fasten the anchors to the pallet (e.g., using a bolt/rivet assembly) results in pallets that are often complicated, heavy and can be expensive to manufacture.

Accordingly, a need exists for a lightweight cargo pallet with varied attachment options that is easy to manufacture.

SUMMARY

The following simplified summary is supplied to provide a basic understanding of some aspects of the disclosed inventive subject matter. This summary is not an extensive overview, and is not intended to identify key/critical elements or to delineate the scope of the claimed subject matter. Its purpose is to present some concepts in a simplified form as a prelude to the more detailed description that is presented later.

In the present application, at least one of the aluminum panel members is extruded with a T-slot that is used for fastening cargo in location with flexibility. T-slots are used in many applications from computer numerical control (CNC) beds to seat rail tracks for air planes. There are many designs available, and many accessories to facilitate restraint. The advantage of T-slots is their ability to accommodate restraint in a variety of positions along their length. By utilizing extruded aluminum to form the T-slot, they can be produced for a relatively low cost compared to machining a similar T-slot from bar or plate stock.

As described below, a panel structure that is adapted to be extruded with T-slots and friction stir welded is disclosed herein. The panel structure is composed of extruded aluminum, and includes a first extruded member having an upper panel and a lower panel. The upper panel and the lower panel of the first extruded structure are connected by webbing. The panel structure may also include a second extruded member having an upper panel and a lower panel. The upper panel and the lower panel of the second extruded member are also connected by webbing. The first extruded member and the second extruded member may be joined by friction stir welding to form a unitized structure. Additional extruded members may also be joined to the first extruded member, the second extruded member, or to each other by friction stir welding to form a unitized structure. At least the first extruded member includes an extruded T-slot that is configured to allow cargo to be flexibly and removably fastened to the unitized structure.

It is to be understood that both the foregoing general description and the following detailed description are exemplary and explanatory only, and are not restrictive of the invention as claimed.

DETAILED DESCRIPTION

Exemplary embodiments of this disclosure are described below and illustrated in the accompanying figures, in which like numerals refer to like parts throughout several views. The embodiments described provide examples, and should not be interpreted as limiting the scope of the invention. Other embodiments or modifications and improvements of the described embodiments are within the scope of the present invention. Although the panel structure may be alternatively referred to throughout this disclosure as a "cargo pallet," one of ordinary skill in the art would understand that the panel structure disclosed herein may also be used as flooring, decking, wall supports, etc. Thus, references to specific structures (such as cargo pallets) are not intended to limit the many possible applications of the disclosed panel structure.

Figure 1:
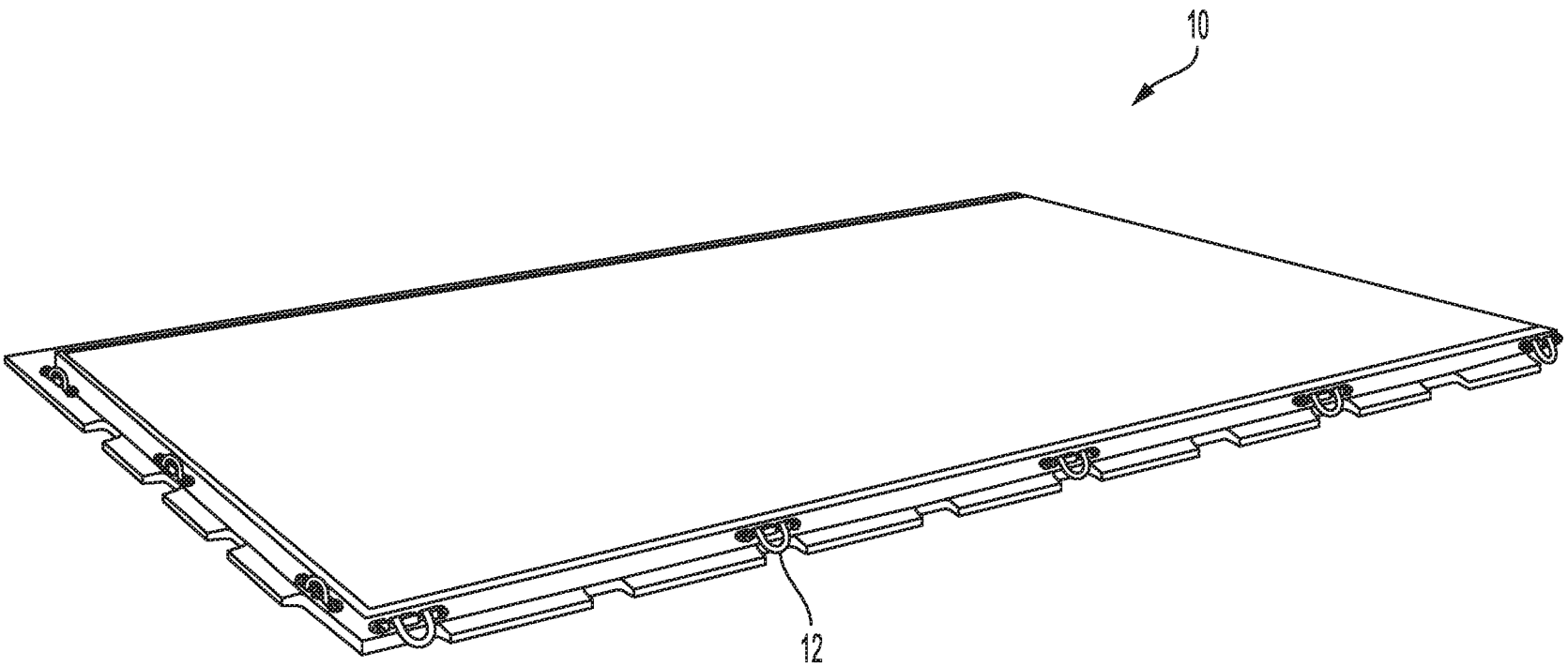
FIG. 1 PRIOR ART
FIG. 1 is a perspective view of a prior art panel structure having a balsa wood core and tie-down rings on the perimeter.
Figure 2:
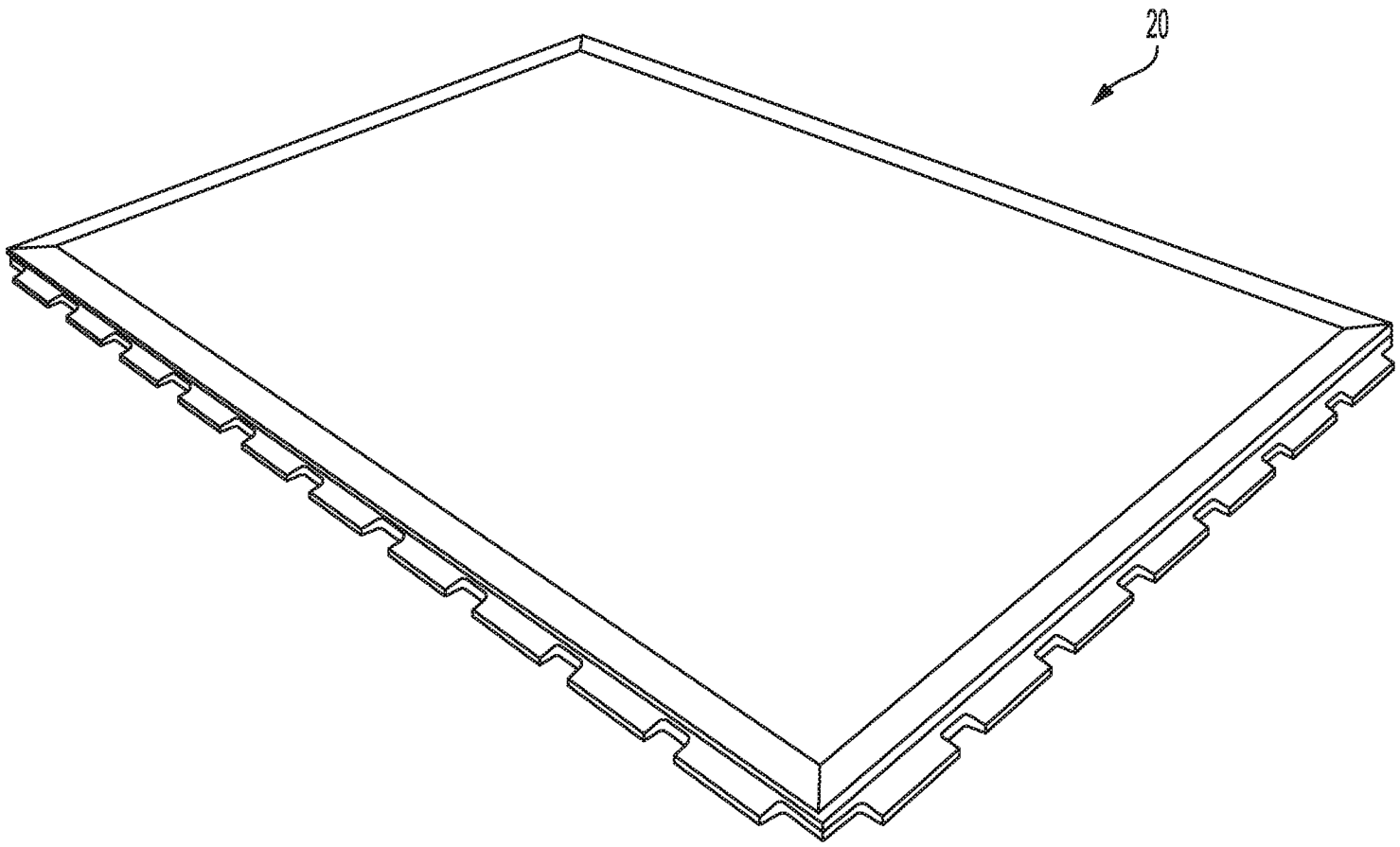
FIG. 2 PRIOR ART
FIG. 2 is a perspective view of another prior art panel structure that is fastened together using a bolt and rivet assembly.
Figure 3:
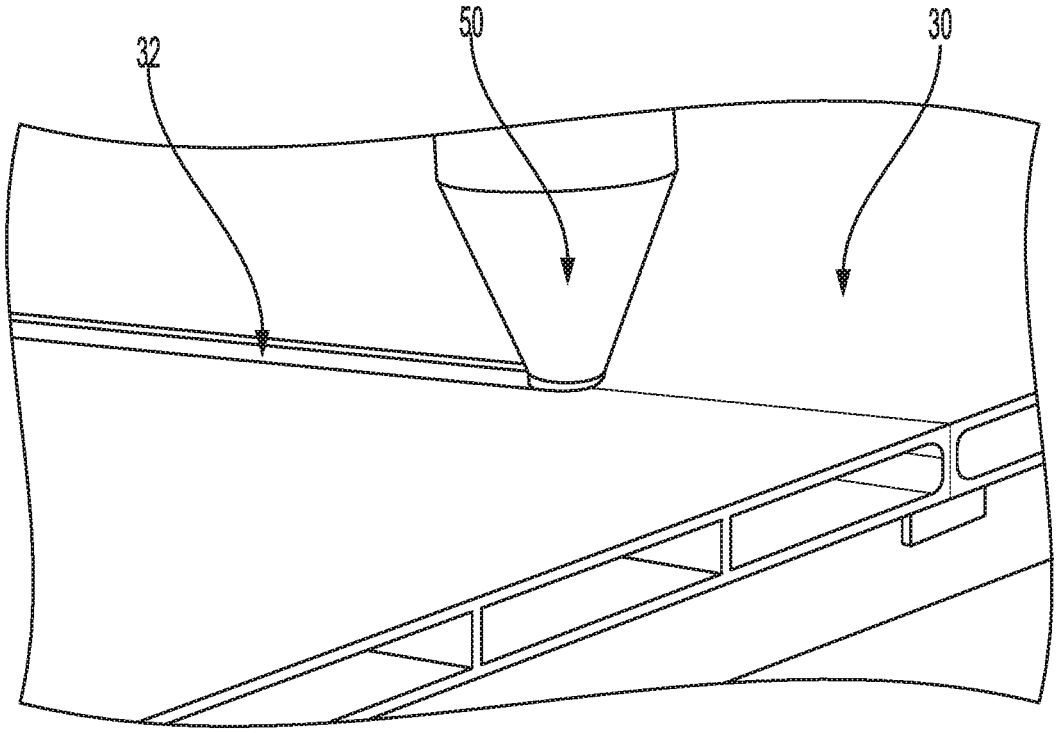
FIG. 3 PRIOR ART
FIG. 3 is a perspective view of another prior art panel structure that is being fastened together using the friction stir welding technique.

FIG. 3 illustrates a cargo pallet 30 that is in the process of assembly using the friction stir welding technique discussed above. The cargo pallet 30 includes several extruded aluminum panel members that are being welded together via friction stir welding by means of an FSW tool 50 to form a unified structure (the cargo pallet 30). A friction stir weld line 32 is apparent on the surface of the cargo pallet 30. The dimensions and shape of the extruded panel members may vary depending on the application and environment in which the pallet is being used. The same FSW technique could be used to form a panel for use in other structures such as bridge decking, for example.

Figure 4:
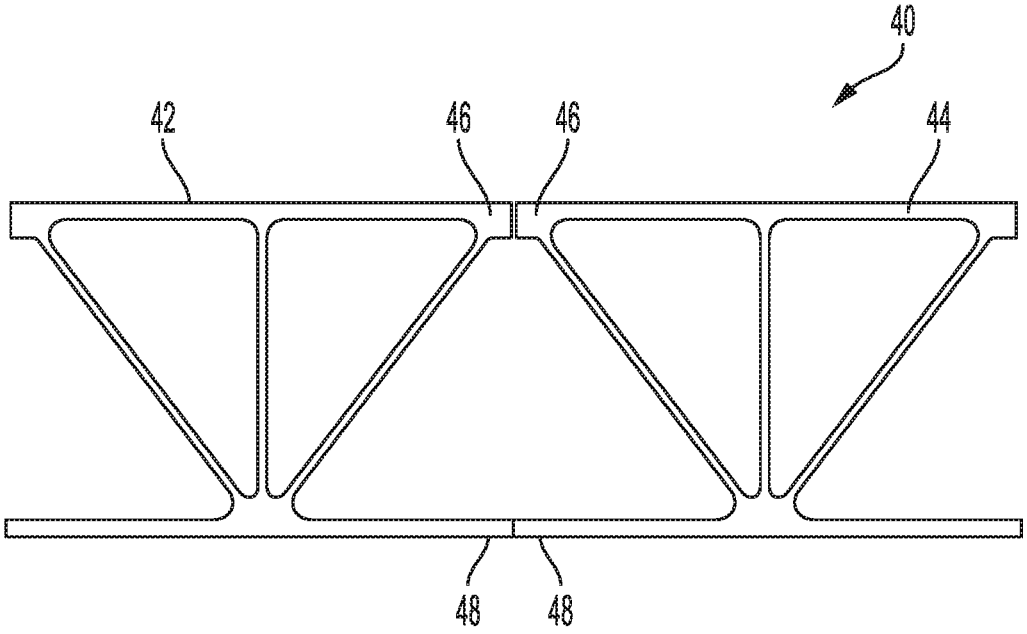
FIG. 4 is a vertical elevation view of exemplary abutment joints between adjacent panel members of an extruded panel structure.

FIG. 4 shows an example of two extruded aluminum panel members 42 and 44 that are in abutment with one another prior to being friction stir welded together to form a cargo pallet 40. In the example of FIG. 4, two blunt flanges 46 and 48 abut one another. However, adjacent panel members may also be connected by interlocking flanges or other mating arrangements suitable for maintaining the relative location of the panel members 42 and 44. The blunt vertical surface of each respective upper and lower flange 46 and 48 is positioned to be in contact with the blunt vertical surface of the other upper and lower flange 46 and 48 prior to using an FSW process to secure the panel members 42 and 44 together.

Figure 5:
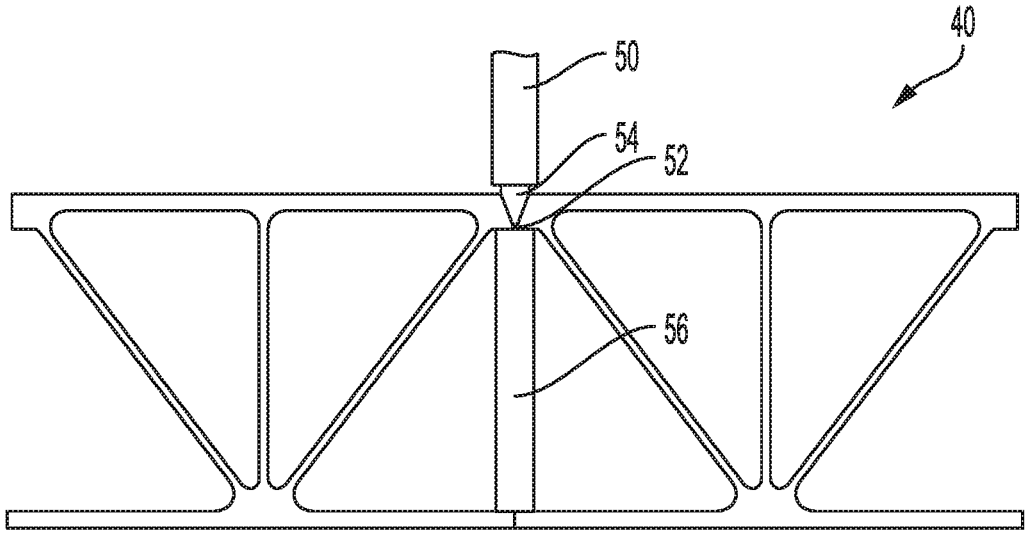
FIG. 5 is a vertical elevation view of an FSW pin being applied to the surface of an upper plate of an abutment joint in a panel with an anvil beneath the upper surface.

FIG. 5 is an elevation view of the application of an FSW pin 50 to the upper panels of two panel members. As used herein, the blunt vertical surfaces 52 of each upper and lower flange 46, 48 may also be referred to as faying surfaces 52, or collectively, an abutment joint 52. The panel members may be connected using an FSW tool 50 that is applied to weld together the adjacent surfaces 52 of the upper and lower flanges 46, 48. Once welding is complete, and the panel members are permanently connected, the joined region may be referred to as a weld line 32 (as seen in FIG. 3). An FSW tool 50 comprises a pin 54 which imparts vertical and rotational frictional pressure on the faying surface 52 of the upper flange 46 of each panel member 42, 44. In one embodiment, an anvil 56 may be used as support for the faying surface 52 during the friction stir welding process.

Figure 6:
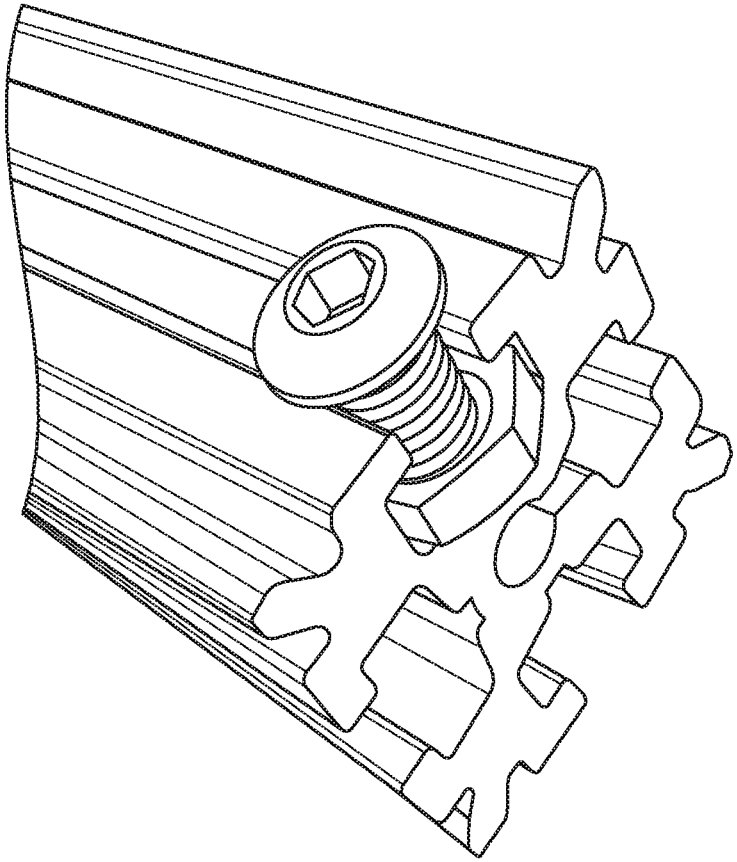
FIG. 6 is a perspective view of an exemplary extruded aluminum bar including a plurality of T-slots.

FIG. 6 shows an example of one type of T-slot 61 that can be extruded as part of an aluminum panel member. However, the T-slot can take other forms and shapes, and the design of the T-slot in the present application is not limited to any of the examples described herein.

Figure 7:
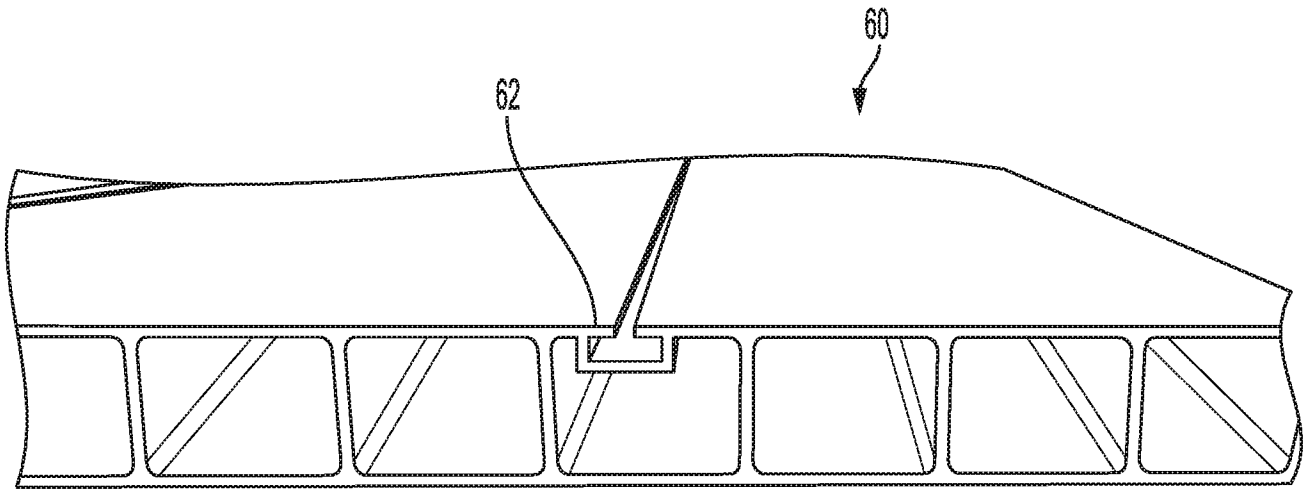
FIG. 7 is a modified photograph illustrating an exemplary extruded panel member that includes a T-slot.

FIG. 7 shows an example of a cargo pallet 60 that is comprised of several extruded aluminum panel members that have been friction stir welded to form a unitized structure or panel. Although, referred to as a pallet, the panel 60 may be configured for use as another structural element such as bridge decking or container walls, for example. As can be seen in FIG. 7, at least one of the panel members is extruded with a T-slot 62. Extruding the T-slot 62 as part of the panel member eliminates the need for fasteners such as used on the 463L pallet, since the T-slot 62 is an integrated part of the fundamental structure of the pallet 60 itself. In alternative embodiments, several rows of T-slots may be integrated into the pallet, thereby providing for broad flexibility to add modular surface mounted structures as well as anchoring cargo retaining straps or other similar restraint mechanisms. Although referred to as a "T" slot, the shape and configuration of the T-slot may be modified or adapted as necessary to match the configuration of a grappling structure used by a tie down line or other cargo restraining member.

Figure 8:
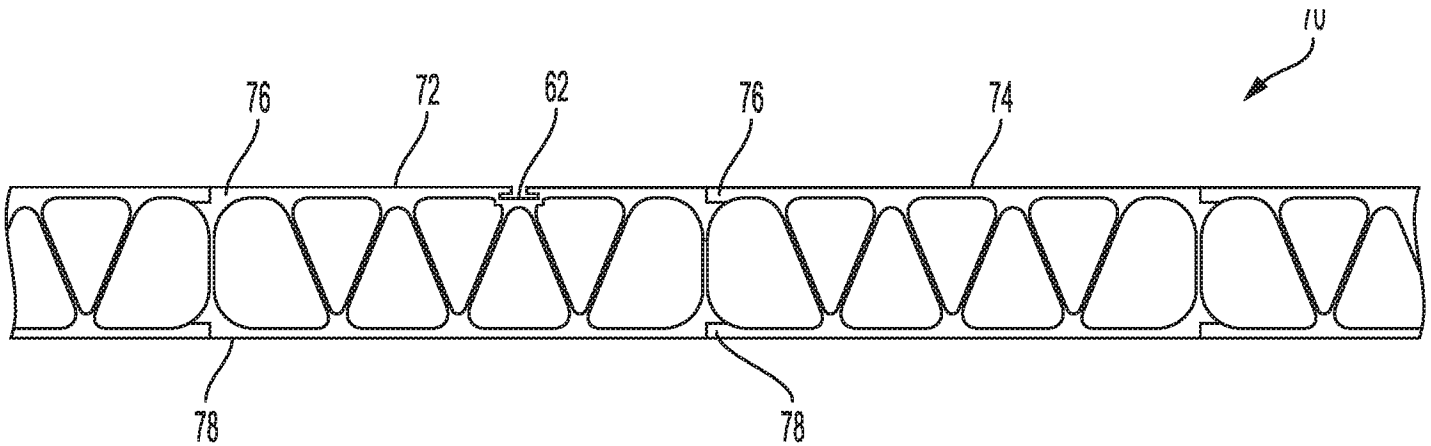
FIG. 8 is a vertical elevation view of an exemplary extruded panel member that includes a T-slot, the panel member being friction stir welded to the other extruded panel members.

FIG. 8 shows an example of a cargo pallet 70 that is comprised of several extruded aluminum panel members that have been welded together to form a unitized structure. As can be seen in both FIGS. 7 and 8, at least one of the panel members is extruded with a T-slot 62. In FIG. 8, each of the panel members is aligned together using abutment joints and may preferably be welded together using, for example, an FSW process. As shown in FIG. 8, a first panel member 72 and a second panel member 74 are positioned adjacent to each other. Each panel member 72, 74 includes an upper plate 76 and a lower plate 78. Although FIG. 8 shows the T-slot 62 as being extruded only as part of the first panel member 72, one of ordinary skill in the art will understand that the T-slot may also be extruded as part of any other panel members. Thus, when the panel members are welded together, the unitized panel structure may include one or more T-slots 62, depending on attachment needs. The position of the T-slot 62 may vary as shown in FIGS. 7 and 8. For example, the T-slot 62 may be positioned above the angled webbing members (or vertical webbing members) which provide additional structural support to the area of the pallet surrounding the T-slot. Alternatively, the T-slot 62 may be positioned between webbing members (as shown in FIG. 7) in order to simplify the geometry of the extruded structure.

By extruding the T-slots 62 as part of one or more panel members, the panel structure disclosed herein allows for direct attachment of cargo using a variety of attachment locations. The panel structure may be configured to accommodate modular mounted surface structures so that the pallet can be a base platform or floor for mounting seats, portable rooms and service modules such as galleys, lavatories, crew berths, etc.

Preferably, the extruded slot structure is located below the exterior surface of an extruded panel member. For example, as shown in FIGS. 7 and 8, the T-slot is located below the surface of the panel. As a result, cargo or other devices being retained may be moved easily across the surface without encountering any interference by the anchoring structure provided by the slot. Thus, the innovative arrangement disclosed herein provides for an improved configuration over existing pallet designs which require any anchoring mechanism to be bolted or otherwise fastened to an surface of the panel.

The friction stir welded panel structure with one or more T-slots provides several advantages and benefits that are not available with conventional panel structures. For example, existing pallet designs that incorporate externally mounted anchoring mechanisms with T-slots are often low volume production items that are built on custom or purpose built platforms. In these pallet designs, unlike the embodiments disclosed herein, the T-slot mechanism is not integrated into a panel member. The anchoring structure that includes the T-slot is fastened or riveted or otherwise connected to the panel. The integrated slot included in the panel structure disclosed in the present application is structurally more efficient. First, the design (e.g., shape and dimensions) of the extruded aluminum panel members may be tailored to a specific application and environment while, at the same time, including T-slots that are integrated in into the panel structure. Second, friction stir welding the panel members together to form the unitized structure (without any externally mounted anchoring mechanism) is more cost efficient, light weight and less complicated than a heavy, complicated panel that includes anchoring mechanism that are connected to the panel using fasteners.

Although the above disclosure has been presented in the context of exemplary embodiments, it is to be understood that modifications and variations may be utilized with departing from the spirit and scope of the invention, as those skilled in the art will readily appreciate. Such modifications and variations are considered to be within the purview and scope of the appended claims and their equivalents. For example, the description of the slot in the pallet as a "T" shape is exemplary only. The shape of the slot may be modified as necessary to match the grappling structure of a tie down line or similar cargo retaining member. The slot structure is configured to provide a consistent catch type structure for connecting to a hook or other similar structure at any point along the length of the slot.

It is also important to note that the construction and arrangement of the elements of the structure as shown and described in the exemplary embodiments is illustrative only. Although only a certain number of embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the assemblies may be reversed or otherwise varied, the length or width of the structures and/or members or connectors or other elements of the system may be varied, the nature or number of adjustment or attachment positions provided between the elements may be varied. It should be noted that the elements and/or assemblies of the system may be constructed from any of a wide variety of materials that provide sufficient strength or durability. Accordingly, all such modifications are intended to be included within the scope of the present disclosure. The order or sequence of any process or method steps may be varied or re-sequenced according to alternative embodiments. Other substitutions, modifications, changes and omissions may be made in the design, operating conditions and arrangement of the exemplary embodiments without departing from the spirit of the present subject matter.

An exemplary embodiment of the innovative panel structure can be described as follows. A panel structure composed of extruded aluminum, the panel structure including: a first extruded member having an upper panel and a lower panel, the upper panel and the lower panel being connected by webbing; a second extruded member having an upper panel and a lower panel, the upper panel and the lower panel being connected by webbing, wherein the first extruded member and the second extruded member are joined by friction stir welding to form a unitized structure; and at least the first extruded member comprises an extruded T-slot along an entire length of the first extruded member, wherein the T-slot is configured to allow cargo to be flexibly fastened to the unitized structure.

What is claimed is:

1. A panel structure comprised of a plurality of extruded aluminum panel members, wherein the extruded aluminum panel members are joined together into a single structure by a friction stir welding process, wherein at least one of the extruded aluminum panel members includes an extruded slot running along an entire length of the at least one of the extruded aluminum panel members, wherein at least one of the extruded aluminum panel members includes an upper panel and a lower panel, and wherein the upper panel and the lower panel are connected to each other by a plurality of webbing members, and wherein the extruded slot is positioned at a point where one of the plurality of webbing members meets the upper panel.

2. The panel structure of claim 1, wherein the extruded slot is a T-shape configuration.

3. The panel structure of claim 1, wherein the extruded slot is configured to provide a consistent catch type structure for connecting a grappling structure at any point along the length of the extruded slot.

4. The panel structure of claim 1, wherein the extruded slot is configured to allow objects to be removably fastened to the panel structure.

5. The panel structure of claim 1, wherein the extruded slot comprises a configuration that matches a grappling structure of a cargo retaining member.

6. The panel structure of claim 1, wherein the panel structure is able to accommodate modular mounted surface structures attached to at least one point along the extruded slot.

7. An extruded aluminum panel member, wherein the extruded aluminum panel member is configured to be joined to at least one other extruded aluminum panel member by a friction stir welding process, wherein the extruded aluminum panel member includes an extruded slot running along an entire length of the extruded aluminum panel member, wherein at least one of the extruded aluminum panel members includes an upper panel and a lower panel, and wherein the upper panel and the lower panel are connected to each other by a plurality of webbing members, and wherein the extruded slot is positioned at a point where one of the plurality of webbing members meets the upper panel.

8. The extruded aluminum panel member of claim 7, wherein the extruded slot includes a T-shape configuration.

9. The extruded aluminum panel member of claim 7, wherein the extruded slot is configured to provide a consistent catch type structure for connecting a hook or other similar structure to the extruded slot at any point along the length of the extruded slot.

10. The extruded aluminum panel member of claim 7, wherein the extruded slot is configured to allow objects to be flexibly fastened to the extruded aluminum panel member.

11. The extruded aluminum panel member of claim 7, wherein the extruded slot comprises a configuration that matches a grappling structure of a tie down line or retaining member.

12. The extruded aluminum panel member of claim 7, wherein the extruded aluminum panel member is able to accommodate modular mounted surface structures attached to at least one point along the extruded slot.

13. A system of cargo transportation, wherein the system utilizes at least one panel structure comprised of a plurality of extruded aluminum panel members, wherein the extruded aluminum panel members are joined together into a single structure by a friction stir welding process, wherein at least one of the extruded aluminum panel members includes an extruded slot running along an entire length of the extruded aluminum panel member, wherein at least one of the extruded aluminum panel members includes an upper panel and a lower panel, and wherein the upper panel and the lower panel are connected to each other by a plurality of webbing members, and wherein the extruded slot is positioned directly adjacent where two of the plurality of webbing members meet the upper panel.

14. The system of claim 13, wherein the extruded T-slot comprises a configuration that matches a grappling structure of a cargo retaining member.

15. The system of claim 13, wherein the extruded slot is positioned in the upper panel directly above where two of the plurality of webbing members meet the upper panel.

16. The panel structure of claim 1, wherein the plurality of webbing members form a substantially triangular shape when viewed from a side of the panel structure at one end of the extruded slot, and wherein the extruded slot is positioned at the point where two of the plurality of webbing members come together at the upper panel to form a corner of the substantially triangular shape.

* * * * *